US006517216B1

(12) United States Patent
Cercone et al.

(10) Patent No.: US 6,517,216 B1
(45) Date of Patent: Feb. 11, 2003

(54) ADJUSTABLE FLUORESCENT LIGHTING FIXTURES

(75) Inventors: Samuel P. Cercone, Aliquippa, PA (US); Katherine Katz, Aliquippa, PA (US)

(73) Assignee: Brightline, L.P., Crescent, PA (US)

( * ) Notice: Subject to any disclaimer, the term of this patent is extended or adjusted under 35 U.S.C. 154(b) by 0 days.

(21) Appl. No.: 09/662,710

(22) Filed: Sep. 15, 2000

Related U.S. Application Data

(60) Provisional application No. 60/154,499, filed on Sep. 17, 1999, and provisional application No. 60/195,903, filed on Apr. 10, 2000.

(51) Int. Cl.[7] ..... F21V 21/26

(52) U.S. Cl. ..... 362/220; 362/271; 362/272; 362/286; 362/371; 362/295; 362/428

(58) Field of Search ..... 362/220, 260, 362/269–275, 285–287, 428, 429, 295, 33, 147, 148, 371, 427

(56) References Cited

U.S. PATENT DOCUMENTS

| | | | | |
|---|---|---|---|---|
| 2,344,935 A | | 3/1944 | Whittaker | 362/219 |
| 3,287,552 A | | 11/1966 | Drandell | 362/233 |
| 3,643,086 A | | 2/1972 | Shaw | 362/364 |
| 3,702,928 A | | 11/1972 | Alger | 362/33 |
| 3,974,371 A | | 8/1976 | Miles, Jr. | 362/341 |
| 4,161,019 A | | 7/1979 | Mulvey | 362/147 |
| 4,171,535 A | | 10/1979 | Westermann | 362/406 |
| 4,180,850 A | | 12/1979 | Bivens | 362/285 |
| 4,204,274 A | | 5/1980 | Lüderitz | 362/239 |
| 4,280,167 A | * | 7/1981 | Ellett | 362/33 |
| 4,287,554 A | | 9/1981 | Wolff | 362/218 |
| 4,419,717 A | | 12/1983 | Price et al. | 362/148 |
| 4,454,569 A | * | 6/1984 | Maguire | 362/33 |
| 4,511,954 A | | 4/1985 | Marcus et al. | 362/275 |
| 4,716,504 A | | 12/1987 | Pahl et al. | 362/150 |
| 4,729,080 A | | 3/1988 | Fremont et al. | 362/366 |
| 4,739,454 A | | 4/1988 | Federgreen | 362/133 |
| 4,779,178 A | | 10/1988 | Spitz | 362/260 |
| 4,811,177 A | * | 3/1989 | Lauckhardt et al. | 362/220 |
| 4,855,886 A | | 8/1989 | Eijkelenboom et al. | 362/350 |
| 4,881,157 A | | 11/1989 | Pahl | 362/371 |
| 4,924,365 A | | 5/1990 | Bogdanovs | 362/224 |
| 4,947,297 A | | 8/1990 | Druffel et al. | 362/147 |
| 4,967,324 A | | 10/1990 | Barclay | 362/147 |
| 4,999,757 A | | 3/1991 | Poppenheimer | 362/287 |
| 5,025,349 A | * | 6/1991 | Gow | 362/147 |
| 5,050,047 A | | 9/1991 | Viner et al. | 362/552 |
| 5,062,029 A | * | 10/1991 | Engel | 362/287 |
| 5,072,127 A | | 12/1991 | Cochran et al. | 250/572 |

(List continued on next page.)

FOREIGN PATENT DOCUMENTS

| | | |
|---|---|---|
| DE | 2651912 | 5/1978 |
| DE | 19624707 | 1/1998 |
| FR | 2395460 | 1/1979 |

OTHER PUBLICATIONS

World Wide Web, http://www.navitar.com/av/hilite/hilitegen.htm, "Itrix Hi–Lite Videoconferencing Lighting," Navitar, Inc. Webpage, Jun. 22, 1999, pp. 1–6, last visited Jan. 19, 2001.

*Primary Examiner*—Alan Cariaso
(74) *Attorney, Agent, or Firm*—Webb Ziesenheim Logsdon Orkin & Hanson, P.C.

(57) ABSTRACT

The present invention includes an adjustable lighting fixture having a housing and light holders which are able to extend, pivot, spin, and slide with respect to the housing, a mounting arm, or each other. The lighting fixture may thus provide enhanced lighting during events, such as live performances, teleconferencing, filming, or videotaping. Each adjustable lighting fixture generally includes a light holder positioned on a mounting arm pivotally or otherwise movably connected to the housing. The lighting fixture uses fluorescent light sources. When enhanced lighting is not required, the light holders may be restored in the housing in an aesthetic manner.

58 Claims, 11 Drawing Sheets

U.S. PATENT DOCUMENTS 5,081,566 A * 1/1992 Crispin et al. ..... 362/147
5,145,249 A 9/1992 Bruckner ..... 362/365
5,226,708 A 7/1993 Katahira et al. ..... 362/9
5,235,497 A 8/1993 Costa ..... 362/224
5,268,824 A 12/1993 Czipri ..... 362/477
5,412,551 A 5/1995 Newell ..... 362/241
5,564,815 A 10/1996 Littman et al. ..... 362/147
5,588,732 A 12/1996 Sasaki et al. ..... 362/10
5,609,408 A 3/1997 Targetti ..... 362/523
5,609,413 A 3/1997 Lecluze ..... 362/364
5,613,766 A 3/1997 Raouf ..... 362/287
5,615,942 A 4/1997 Langis ..... 362/220
5,672,002 A 9/1997 Todd, Jr. ..... 362/294
5,675,417 A 10/1997 Ventura et al. ..... 356/371
5,704,702 A 1/1998 Goto ..... 362/5
5,713,658 A 2/1998 Strangan, Jr. ..... 362/220
5,713,662 A 2/1998 Kira ..... 362/427
5,803,585 A 9/1998 Littman et al. ..... 362/147
5,855,427 A 1/1999 Lassovsky ..... 362/283
6,129,444 A * 10/2000 Tognoni ..... 362/295
6,230,172 B1 * 3/2001 Wanuch et al. ..... 362/260

* cited by examiner

ADJUSTABLE FLUORESCENT LIGHTING FIXTURES

CROSS-REFERENCE TO RELATED APPLICATION

This application is related to earlier filed U.S. Provisional Patent Application Serial Nos. 60/154,499, filed Sep. 17, 1999, entitled "Multi-Purpose Fluorescent Lighting Fixtures" and 60/195,903, filed Apr. 10, 2000, entitled "Multi-Purpose Fluorescent Lighting Fixtures."

BACKGROUND OF THE INVENTION

1. Field of the Invention

The present invention relates to lighting fixtures and, more particularly, to fluorescent lighting fixtures adapted for permanent mounting in or adjacent to a wall or ceiling.

2. Brief Description of the Prior Art

Illumination devices are commonly found in residential, commercial, or municipal applications. These devices typically take on many forms, depending on the type or intensity of luminance desired.

For example, U.S. Pat. No. 3,702,928 issued to Alger discloses a remote controlled adjustable dental operating light. U.S. Pat. No. 5,672,002 to Todd, Jr. discloses a light assembly that can be secured to a ceiling fan. Other examples include U.S. Pat. No. 3,974,371 to Miles, Jr. which discloses an adjustable light fixture recessible in a ceiling for directing light toward an object at various angles; U.S. Pat. No. 4,881,157 to Pahl which discloses a lamp fixture housing which is recessed in a ceiling; U.S. Pat. No. 5,609,413 to Lecluze which discloses an adjustable light fixture recessed in a ceiling or wall for directing light at various angles; U.S. Pat. No. 5,412,551 to Newell which discloses a luminaire having the shape of a flatened, elongated V and a lamp positioned directly above the point of the V; and U.S. Pat. No. 5,613,766 to Raouf which discloses an adjustable wall mounted luminary made up of a ballast housing and a reflector housing containing a light source.

In general, the prior art can be subdivided into two types of illumination devices- point source lighting fixtures and wide area lighting fixtures. Point source lighting fixtures are defined herein as those illumination devices which provide concentrated localized lighting over a small area, usually via an incandescent bulb. Desk lamps and dentist lamps are examples of point source lighting fixtures. Point source lighting fixtures are generally semi-mobile since they can be connected to a conventional power outlet, either directly or with the assistance of an extension cord. However, point source lighting fixtures are generally not adequate for illumination of large spaces.

To provide illumination for large spaces, wide area lighting fixtures are usually used. Wide area lighting fixtures are defined herein as those illumination devices which provide lighting over a large area, such as conventional overhead incandescent and fluorescent lighting. These types of illumination devices are usually hard wired to a power source and are generally mounted in or adjacent to a wall or ceiling.

Some wide area lighting fixtures have light holders which are multi-directional or otherwise moveable with respect to a frame. Examples include track lighting and the fixtures disclosed in U.S. Pat. Nos. 3,974,371 to Miles, Jr. and 4,881,157 to Pahl. However, there are still numerous disadvantages to these types of multi-directional wide area lighting fixtures. The most significant disadvantage is that these fixtures are designed to accept a single incandescent light source. Incandescent light sources, such as a standard light bulb, generate a tremendous amount of heat during operation. Therefore, the area of the incandescent light source must increase with increased luminosity in order to make the overall surface of the incandescent light source cooler. Due to the limited space in many ceilings, as well as building and fire code regulations, small, bright, hot incandescent bulbs are disfavored, as are cooler but larger incandescent bulbs.

Because of the problems associated with incandescent light sources, as well as energy and safety concerns, fluorescent lighting fixtures having fluorescent light sources are a preferable alternative to incandescent light sources. In general, fluorescent lighting fixtures are less expensive to operate than incandescent lighting fixtures and provide adequate downlighting over a large area. However, known fluorescent lighting fixtures designed to provide conventional downlighting or enhanced directional lighting are not configured to fold, pivot, or otherwise move conveniently out of the way when the need for enhanced lighting is eviscerated. This drawback reduces headspace and is not aesthetically pleasing.

SUMMARY OF THE INVENTION

It is therefore an object of the present invention to provide a low-profile, adjustable fluorescent lighting fixture having at least one light holder which is able to extend, pivot, spin, and slide with respect to a housing, mounting surface, such as a ceiling or wall, or another light holder.

By way of example only and without limitation to the following combinations, the light holders of the present invention are adjustable to provide: (a) enhanced fluorescent lighting, (b) fluorescent broadcast lighting, (c) normal fluorescent downlighting, and (d) enhanced fluorescent broadcast lighting. Fluorescent downlighting is defined herein as normal wide area lighting over a general area. Enhanced fluorescent lighting is defined herein as light which is adjustably directed toward a particular location, person, place, or thing, such as during live performances, teleconferencing, filming, videotaping, or accent lighting. Fluorescent broadcast lighting is defined herein as lighting which is particularly designed for use with video, film, or teleconferencing applications and generally includes fluorescent bulbs designed for such applications. Finally, enhanced fluorescent broadcast lighting is herein defined as enhanced fluorescent lighting having fluorescent light sources, such as broadcast quality fluorescent bulbs, designed for video, film, or teleconferencing applications.

Although fluorescent downlighting can also function as fluorescent broadcast lighting if a broadcast quality fluorescent bulb is used, enhanced fluorescent broadcast lighting (which is position adjustable) is preferred in most video, film, or teleconferencing applications. Using a proper fluorescent light source and the proper placement of the light holders is important to create dimensionality and interest. If fluorescent broadcast lighting is used, without enhanced fluorescent broadcast lighting, images may appear flat and shadowy and objects in the foreground recede into the background. The angle at which light strikes a location, person, place, or thing is of great importance with reference to the person or the camera receiving the image.

One embodiment of an adjustable lighting fixture according to the present invention includes a housing forming an interior cavity. A light holder is positioned in the interior cavity of the housing. The light holder is configured to be moved with respect to the housing, and a fluorescent light source is connected to the light holder. The light source is connected to a ballast, which may be configured to receive a digital or analog signal from a controller to dim and brighten the light source. The adjustable fluorescent lighting fixture is movable from a storage downlighting position to an enhanced lighting position and vice versa. A multi-purpose combination according to the invention can be configured to provide fluorescent downlighting when the light holder is in the storage/downlighting position and enhanced fluorescent lighting when the light holder is moved into the enhanced lighting position. As previously stated, if a broadcast quality fluorescent bulb is used, fluorescent broadcast lighting and enhanced fluorescent broadcast lighting may also be provided.

The housing is preferably mounted in or adjacent to a ceiling and hard wired to a power source. Each light holder may include a reflector positioned between the light holder and a light source, a light source clip configured to receive the light source, a safety latch, and filter material. Each light holder is pivotally movable with respect to the housing or is connected to an extension arm which is connected to both the housing and the light holder. The extension arm can be a telescoping glide bracket, a connection plate having slide members slideably engaging the connection plate, or other suitable device. A pivot joint may be positioned between the extension arm and the light holder to allow the light holder to be rotatable at least 90 degrees about a longitudinal axis of the extension arm and to pivot at least 15 degrees with respect to the extension arm.

In another embodiment, the housing is a hollow box generally having a first wall, a second wall, a third wall opposite the first wall, and a fourth wall opposite the second wall. The light holder has a longitudinal axis, wherein the longitudinal axis of the light holder passes through the intersection of the first and second walls and the third and fourth walls of the housing, thereby orienting the light holder in an angled fashion within the housing.

One possible fluorescent lighting system includes an adjustable fluorescent lighting fixture connected to a fixed power source. The adjustable fluorescent lighting fixture has a light holder and a fluorescent light source connected to the light holder. The light holder may be simply stored in a storage position and moved to provide enhanced fluorescent lighting in an enhanced lighting position, or the light holder may provide fluorescent downlighting in the storage position. Finally, the light holder may provide fluorescent broadcast lighting or enhanced fluorescent broadcast lighting. A ballast which is either not adjustable or adjusted, such as by a controller, is connected to the light holder. The controller is connected to the ballast.

In one application, the ballast receives a 0–10 Volt electronic signal from the controller, such as an analog potentiometer. Alternatively, the ballast may receive a digital signal from the controller. In either case, the controller can be manipulated manually, through a computer, or through a remote control. In digital applications, a DMX-512 box may be positioned between the controller and the ballast, wherein a DMX-512 controller sends a digital DMX-512 signal through the DMX-512 box to the ballast. In yet another configuration, a DMX-512 control chip is integrated with the ballast.

In addition to manipulation of the ballast, motors in the housing may also be controlled as discussed above, except that a continuous analog voltage is used, as opposed to a varying analog voltage. In operation, the controller sends signals to the ballasts and motors, either individually or in series, which permits one or more light sources connected to the light holder to be brightened or dimmed and permits the light holder to be moved in at least one direction with respect to the housing. In digital applications, a DMX-512 box or other suitable device is positioned between the controller and the ballasts or motors positioned in the housing.

A method to produce enhanced fluorescent lighting with an adjustable fluorescent lighting fixture equipped with at least one fluorescent light holder is also disclosed. Some steps include:

a. moving the fluorescent light holder from a storage position to an enhanced lighting position with respect to a housing to provide enhanced fluorescent lighting;

b. moving the fluorescent light holder from the enhanced lighting position to the storage position with respect to a housing to provide storage; or, alternatively, c. moving the fluorescent light holder from the enhanced lighting position to the storage position to provide fluorescent downlighting. In any step, the fluorescent light holder is pivoted with respect to the adjustable fluorescent lighting fixture housing or moved in a direction away from the adjustable fluorescent lighting fixture housing.

As briefly described above, the present invention represents an improvement in the art of illumination. The adjustable fluorescent lighting fixtures disclosed herein can replace existing fluorescent lighting fixtures in retrofit applications or can be installed in new construction. Another benefit of the present invention is that when light holders contained within the adjustable fluorescent lighting fixtures are oriented for storage or normal downlighting, the adjustable fluorescent lighting fixtures resemble standard commercial fluorescent lighting fixtures. A third benefit is that the adjustable fluorescent lighting fixtures are capable of providing enhanced fluorescent lighting. For example, when the need for enhanced fluorescent lighting or enhanced fluorescent broadcast lighting is required, the fluorescent light holders can be moved from a storage position to an enhanced lighting position, and directed to a particular person, place, or thing. When the need for enhanced fluorescent lighting ceases, the fluorescent light holders can be moved back to the storage position.

These and other advantages of the present invention will be clarified in the Detailed Description of the Preferred Embodiments taken together with the attached drawings in which like reference numerals represent like elements throughout.

DETAILED DESCRIPTION OF THE PREFERRED EMBODIMENTS

Figure 1:
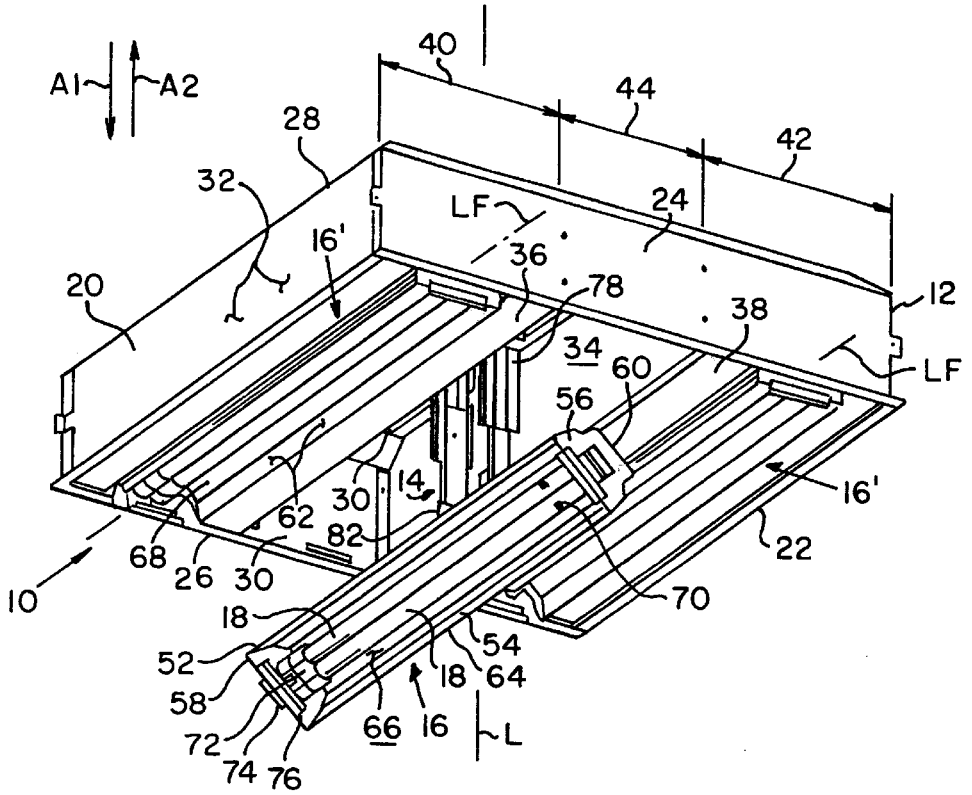
FIG. 1 is a bottom perspective view of an adjustable fluorescent lighting fixture according to one embodiment of the present invention.
Figure 2:
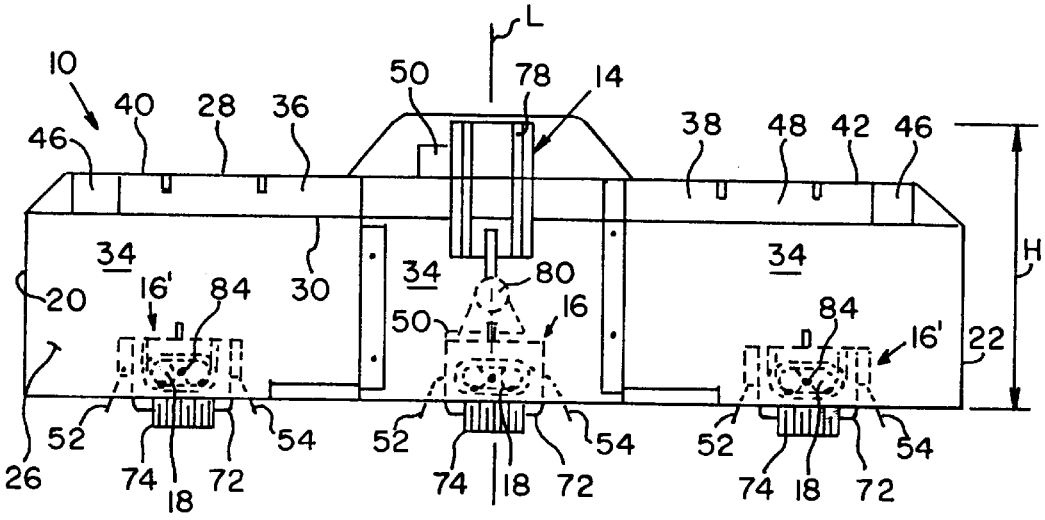
FIG. 2 is a side view of the adjustable fluorescent lighting fixture shown in FIG. 1.
Figure 3:
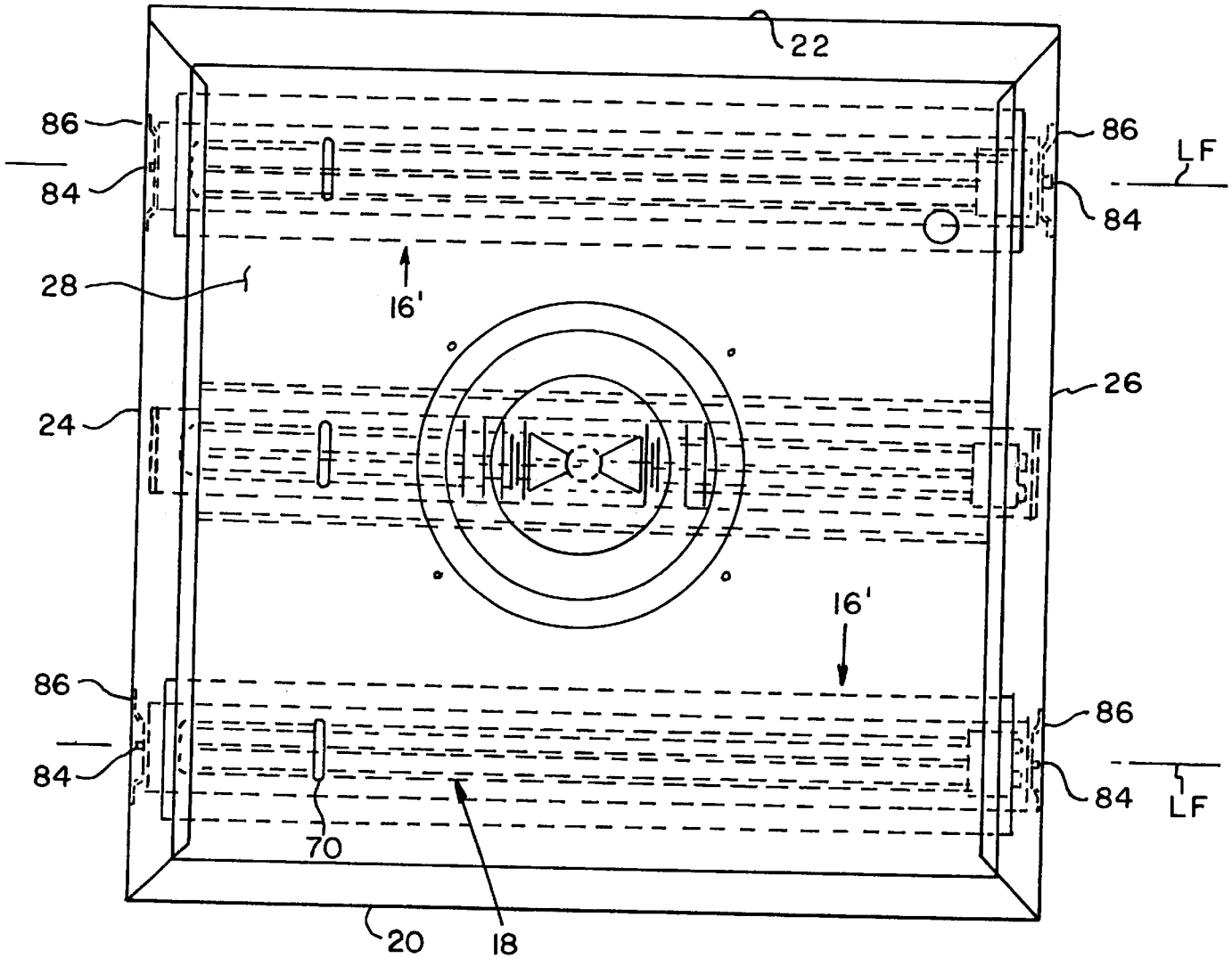
FIG. 3 is a plan view of the adjustable fluorescent lighting fixture shown in FIGS. 1 and 2 with interior walls removed for clarity.

FIGS. 1–3 generally show an adjustable fluorescent lighting fixture 10 having a housing 12 according to a first embodiment of the present invention. The housing 12 is preferably in the shape of a hollow box having a first wall 20, a second wall 22, a third wall 24, a fourth wall 26, and a fifth wall 28 with the walls 20, 22, 24, 26, 28 forming an interior surface 30, an exterior surface 32, and an internal cavity 34. A first interior wall 36 and a second interior wall 38 preferably subdivide the housing 12, forming a first endcap section 40, a second endcap section 42, and a center section 44. A mounting arm 14 is positioned adjacent the interior surface 30 of the housing 12. The mounting arm 14 telescopes or otherwise moves in a first direction A1 and a second direction A2 with respect to the housing 12, moving a light holder 16 connected to the mounting arm 14 from a storage position to an enhanced lighting position. With this type of mounting arm 14, the storage position, shown in FIG. 2, is herein defined as the position where the fluorescent light holder 16 is received in the housing 12 and resembles a normal fluorescent lighting fixture. The enhanced lighting position, shown in FIG. 1, is herein defined as any other position where the fluorescent light holder 16 extends in the A1 direction away from the housing 12 to provide enhanced fluorescent lighting, even if the fluorescent lighting holder 16 is not rotated about a longitudinal axis L of the mounting arm 14 or pivoted with respect to the mounting arm. At least one light source 18 is positioned in the fluorescent light holder 16.

As shown in FIG. 2, the housing 12 is installed in a ceiling having a clearance height H. Each embodiment of the present invention disclosed herein is designed to be installed in retrofit applications or in new construction. Therefore, the overall height, width, and depth of the housing 12 is configured to replace existing conventionally sized light fixtures in new or existing applications. One housing size that accommodates many new and existing applications is 23.6"×23.6"×6" although other suitable shapes and sizes are clearly contemplated depending on the desired application.

With continuing reference to FIG. 2, electronic ballasts 46 are preferably positioned adjacent the interior surface 30 of the housing 12. The ballasts 46 drive the light sources 18. The ballasts 46 may be standard 55 watt ballasts, adjustable analog ballasts, or may also be more complex, with the preferred ballasts being remotely adjustable and controllable digital ballasts, preferably formed from printed circuit boards. The adjustable ballasts may be adjustable to an overall luminosity, such as between 15–100 percent, by analog controls, such as 0–10 Volt potentiometers or by digital controls, digitally by a DMX-512 system (discussed in detail below), or one of the many other lighting control systems known to those in the art. For the DMX-512 controlled systems, each ballast 46 may include an individualized DMX-512 address and may have a DMX-512 controller chip "on board" the electronic ballast 46. Motors 50, such as servo- or stepper motors, may be used to move the light holders 16 with respect to the housing 12 and can also be controlled individually or in series by an analog electronic control panel having analog potentiometers, a digital electronic control panel, such as a DMX-512 control panel, a central processing unit, an infrared or other remote control, or other suitable device. A wire harness 48 is provided adjacent the interior surface 30 of the housing 12 for routing electrical and controller connections, such as insulated wire, coaxial cable, fiber optic cable, or other suitable electrical or signal conveyance.

Referring back to FIG. 1, each light holder 16 generally includes a first holder wall 52, a second holder wall 54, a third holder wall 56, a fourth holder wall 58, and a fifth holder wall 60. The holder walls 52, 54, 56, 58, 60 form an interior holder surface 62, an exterior holder surface 64, and an internal holder cavity 66. A reflector 68 can also be positioned adjacent the interior holder surface 62 of the light holder 16. A light source clip 70 and at least one transformer socket bracket 72 are also positioned in the internal holder cavity 66 of the light holder 16. The light source clips 70 hold light sources 18, which are preferably fluorescent bulbs. Examples include, but are not limited to, 55 watt "biax" fluorescent bulbs, fluorescent bulbs having a frequency range of 20 Khz or higher, or broadcast quality fluorescent bulbs having a color rendering index (CRI) of approximately 75 or higher, with a CRI of 82 or higher being preferred for fluorescent or enhanced fluorescent broadcast lighting, such as for video and teleconferencing applications. To protect the equipment from harm or prevent personal injury caused by hot parts, safety latches 74 are provided on any of the first, second, third, or fourth fixture walls 52, 54, 56, 58 of the light holder 16. Moreover, accessory clips 76 are also provided on any of the first, second, third, or fourth fixture walls 52, 54, 56, 58 of the light holder 16 to allow accent pieces to be positioned adjacent the light sources 18, such as colored plastic or glass.

Figure 4:
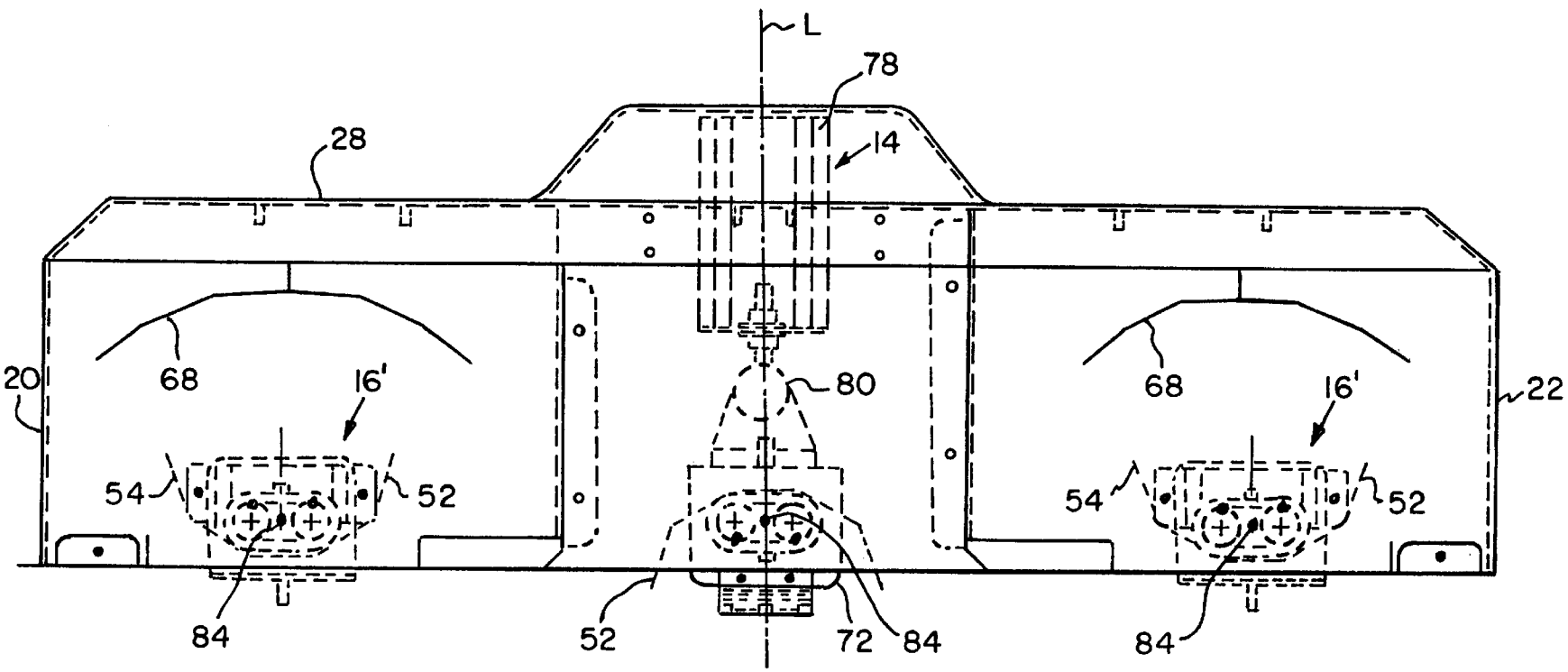
FIG. 4 is a side view of a second embodiment of an adjustable fluorescent lighting fixture with two light holders rotated 180 degrees toward an interior surface of a housing.
Figure 5:
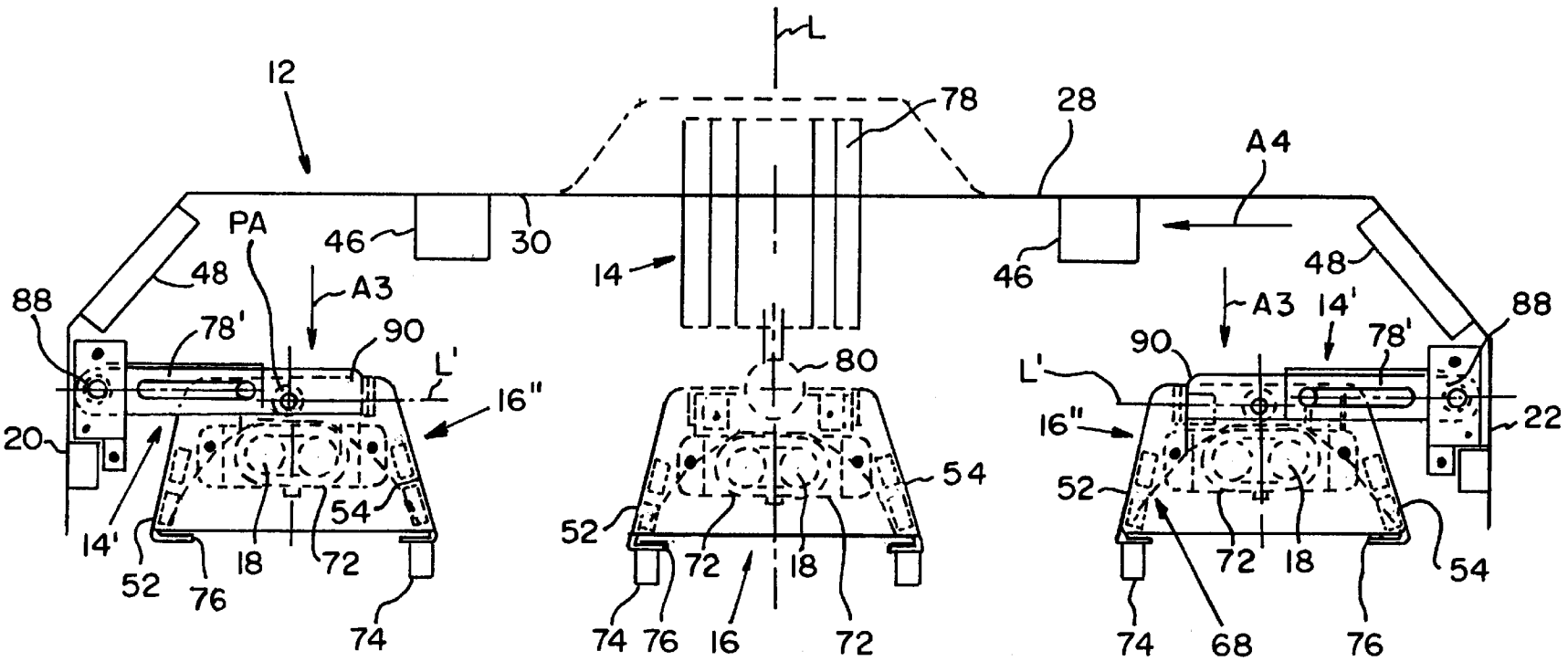
FIG. 5 is an adjustable fluorescent lighting fixture according to a third embodiment of the present invention.

With reference to FIGS. 1 and 2, one possible type of mounting arm 14 telescopes via a pin and slot arrangement, such as glide brackets 78, or is otherwise configured to extend toward or away from the interior surface 30 of the housing 12. As shown in FIG. 2, as well as the second and third embodiments shown in FIGS. 4 and 5, respectively, each telescoping glide bracket 78 partially retracts into the housing 12 providing at least four and one half inches of movement in the A1 direction away from the interior surface 30 of the housing 12. FIGS. 2, 4, and 5 also show a pivot joint 80, preferably a ball-joint, positioned adjacent a second end of the mounting arm 14, between the mounting arm 14 and the fluorescent light holder 16, wherein the fluorescent light holder 16 pivots with respect to the mounting arm 14. The pivot joint 80 allows the fluorescent light holder 16 to pivot 180 degrees with respect to the housing 12 and to rotate 360 degrees about a longitudinal axis L of the mounting arm 14 when the mounting arm 14 is in an extended or second position, as shown in FIG. 1.

Figure 8:
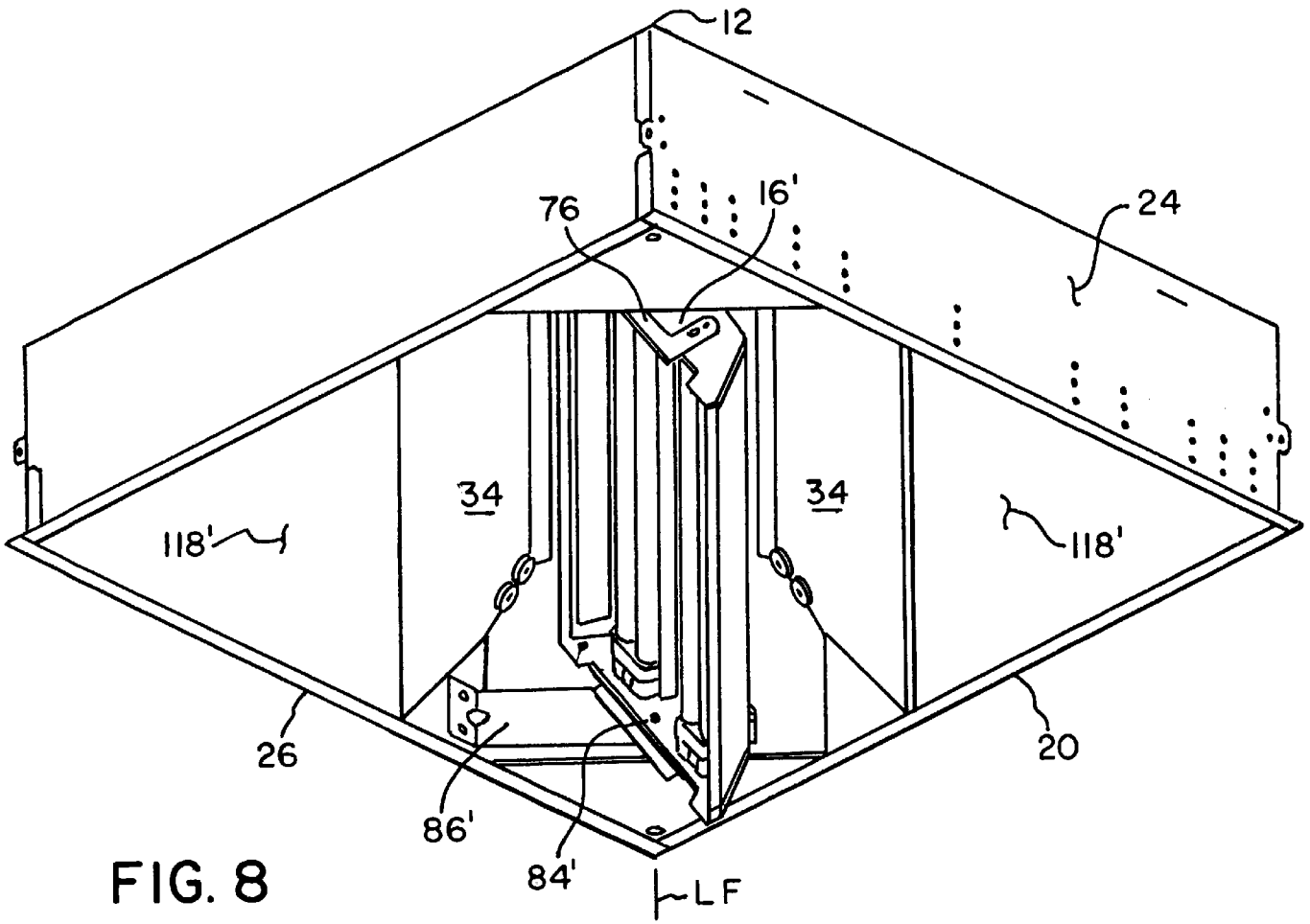
FIG. 8 is an adjustable fluorescent lighting fixture according to a fifth embodiment of the present invention.

Referring again to the first embodiment shown in FIGS. 1–3, the second embodiment shown in FIG. 4, and the fifth embodiment shown in FIG. 8, at least one fluorescent light holder 16' may be pivotally connected to the housing 12 via pin 84 (84' in FIG. 8) and pin mounting bracket 86 (86' in FIG. 8). The pivoting light holder 16' does not extend, but rotates 1 to 180 degrees about axis LF from a storage position to an enhanced lighting position. In this particular configuration, the storage position of the fluorescent light holder 16' is herein defined as the position when the fluorescent light holder 16' resembles normal fluorescent lighting, as shown in FIGS. 1–3. The fluorescent light holder 16' is in an enhanced lighting position when the fluorescent light holder 16' is rotated any distance about axis LF. FIGS. 4, 8, 9, and 12 show the fluorescent light holders 16' in an enhanced lighting position, in that they are rotated about axis LF as not to resemble the orientation of the light holders 16' shown in FIGS. 1–3. One hundred and eighty degree rotation allows the rotating fluorescent light holders 16' to be rotated upward to face the inside of housing 12, as shown in FIG. 4, to provide an indirect fluorescent lighting source. In this regard, additional reflectors 68 may be mounted inside housing 12. The fluorescent light holders 16' that pivot with respect to the housing 12 may also be turned off in teleconferencing applications, with the fluorescent light holder 16 positioned adjacent the mounting arm 14 extending in a second position with respect to the housing 12, as previously discussed.

Figure 10:
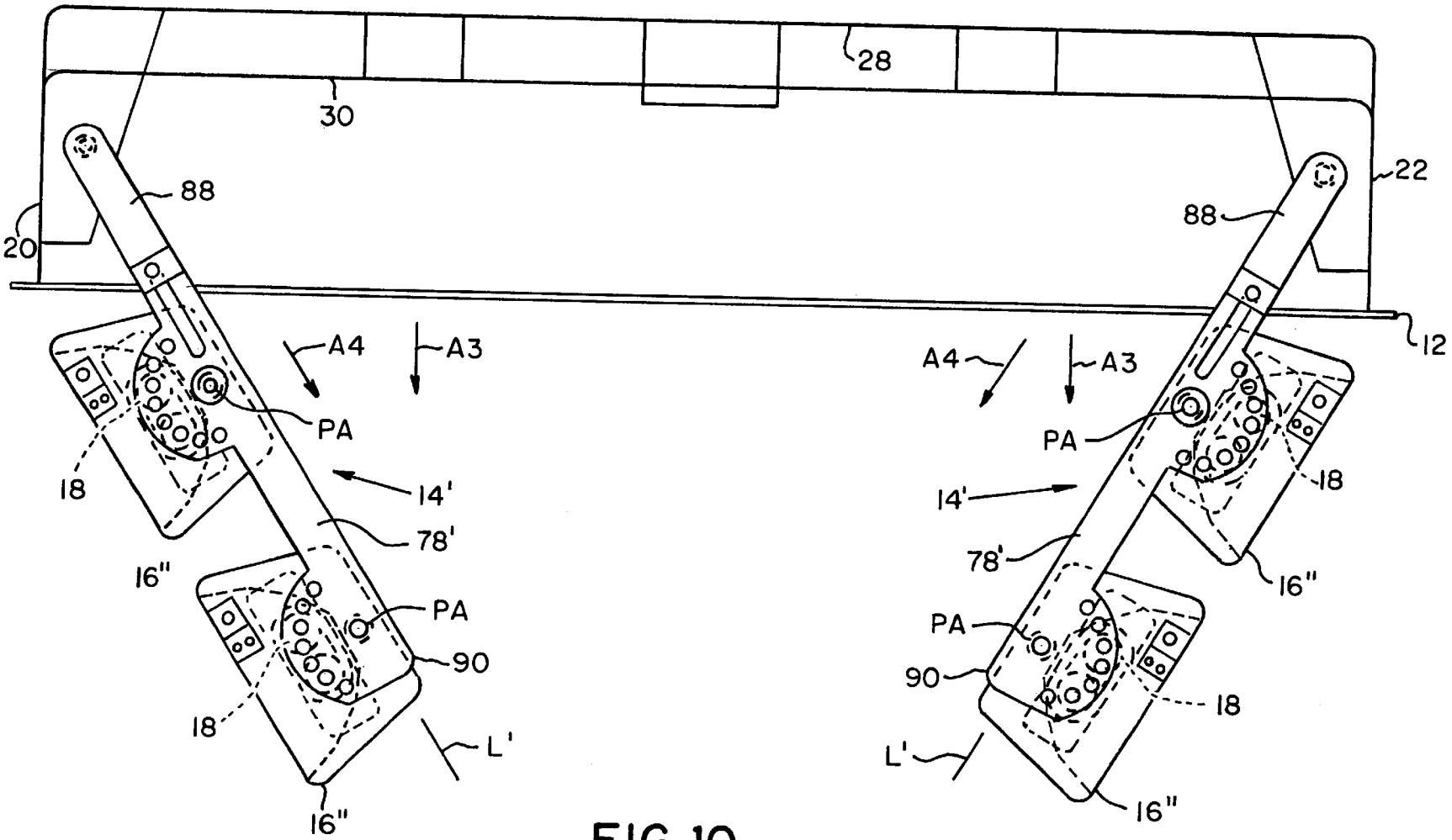
FIG. 10 is an adjustable fluorescent lighting fixture according to a seventh embodiment of the present invention.

In the third and seventh embodiments of the present invention, as shown in FIGS. 5 and 10, a mounting arm 14' is positioned pivotally adjacent the housing 12. The mounting arm 14' is preferably a glide bracket 78' that moves in a first direction, indicated by arrow A3, and telescopes after the mounting arm 14' is moved in a first direction, as indicated by arrow A4. In this particular configuration, the storage position of the mounting arm 14' is herein defined as the position where the light holder attached to the mounting arm 14' resembles normal fluorescent lighting, as shown in FIG. 5. The enhanced lighting position of the mounting arm 14' is herein defined as any other position where the mounting arm 14' is moved in the A3 direction away from the housing 12, as shown generally in FIGS. 10 and 12. A light holder 16" is positioned adjacent to the mounting arm 14', pivoting at least 15 degrees with respect to the mounting arm 14'. Each mounting arm 14' has a first end 88, a second end 90, and a longitudinal axis L', wherein the first ends 88 are each pivotally connected to the first, second, third, fourth, or fifth walls 20, 22, 24, 26, 28, or any combination thereof, of the housing 12, respectively. The mounting arm 14' extends away from the interior surface 30 of the housing 12, preferably pivoting up to 90 degrees away from the interior surface 30 of the fifth wall 28 of the housing 12. The lighting source fixture or fixtures 16" positioned on the mounting arms 14' can be pivoted within approximately 180 degrees about pivot axis PA and slid up and down arm 14' via a pin and slot arrangement, glide bracket 78', or other suitable method.

Figure 6:
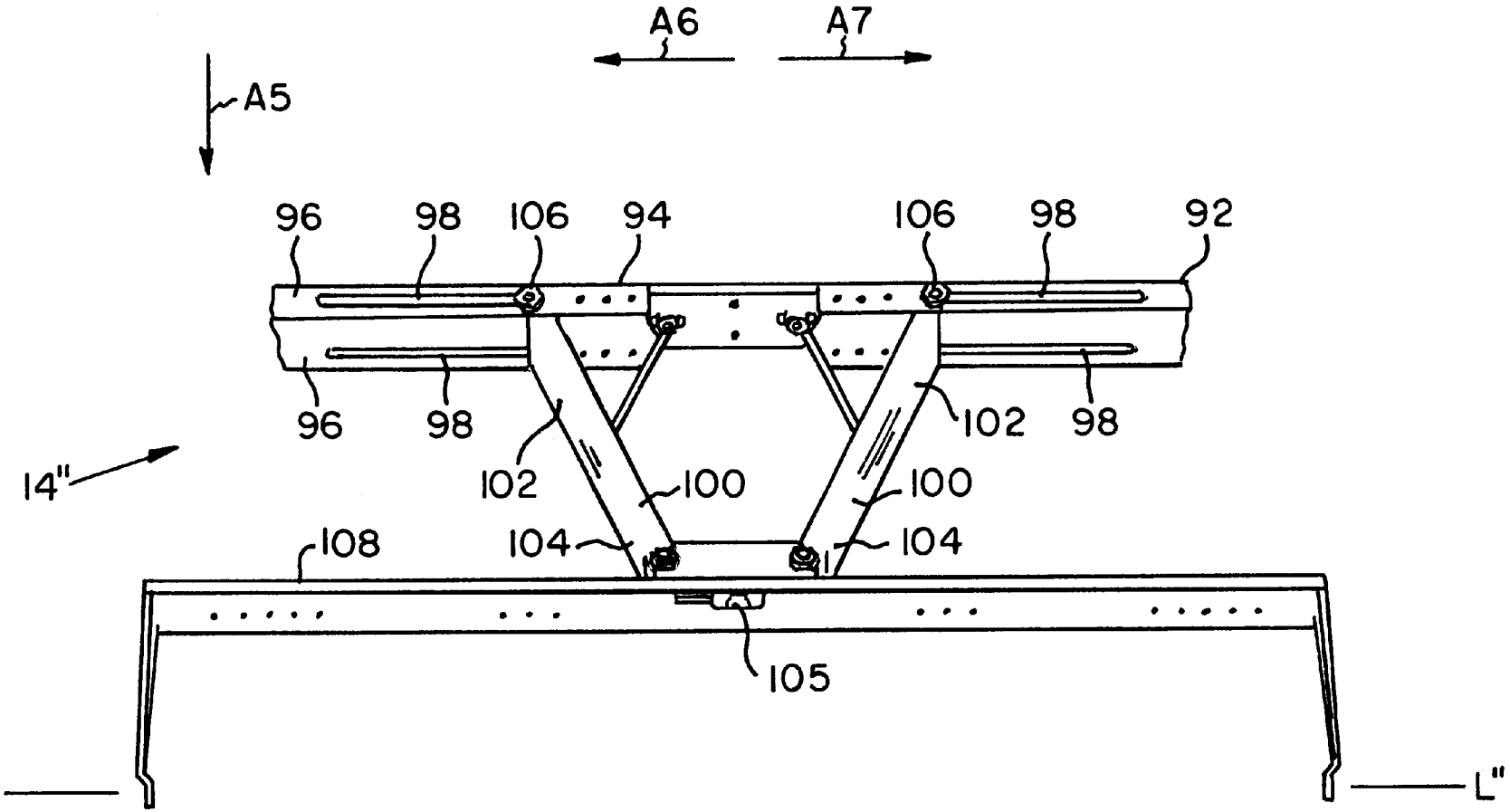
FIG. 6 is a bottom perspective view of one possible pivoting arm according to the present invention.

FIG. 6 shows another type of mounting arm 14". The mounting arm 14" includes a connection plate 92 having a connection surface 94 and forming two rails 96, with each rail 96 forming a corresponding slot 98. The mounting arm 14" further includes a plurality of slide members 100, each slide member 100 having a first slide end 102 and a second slide end 104, with the first slide end 102 of each slide member 100 having a pin 106 slidably engaging a corresponding slot 98 formed by a corresponding rail 96. The second slide end 104 of each slide member 100 is pivotally connected to a light source fixture brace 108, which receives light holder 16. In operation, the connection surface 94 of the connection plate 92 is positioned adjacent to the fifth wall 28 of the housing 12. The light holder 16 is then moved toward or away from the fifth wall 28 of the housing 12, as indicated by arrow A5, by sliding the first slide end 102 of each slide member 100 in the corresponding recess 96 (arrows A6 and A7). This embodiment eliminates the need for the glide bracket 78 (shown in FIGS. 1–5) to retract into the fifth wall 28 of the housing 12, thus reducing the required clearance for the housing. The light source fixture 16 can be pivoted 360 degrees about longitudinal axis L" and further rotated at 360 degrees with respect to the slide members 100 around pin 105.

Figure 7:
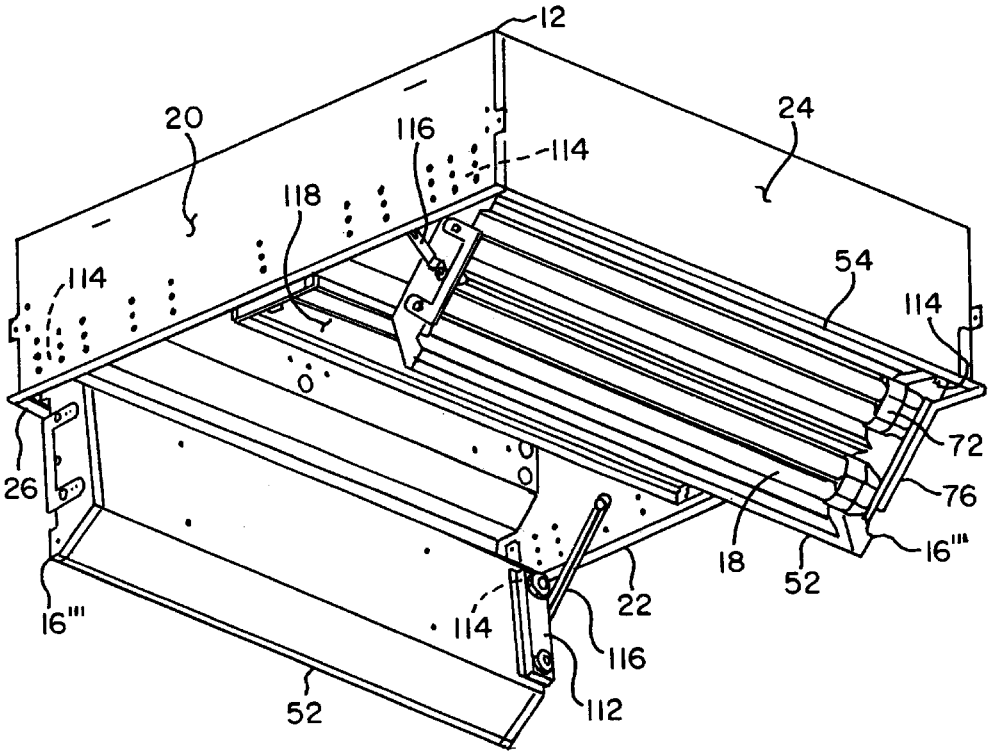
FIG. 7 is an adjustable fluorescent lighting fixture according to a fourth embodiment of the present invention.

A fourth embodiment of the present invention is shown in FIG. 7. FIG. 7 shows two light holders 16''' pivotally connected to opposing walls of the housing 12. Electrical or other connections are concealed by junction box 112. Grommets 114 are positioned at the intersection of the first, second, third, and fourth walls 20, 22, 24, 26 of the housing 12 and each light holder 16''' to help to keep the light holders 16''' in the desired position. Slide stops 116 connected to the housing 12 prevent the light holders 16''' from pivoting more than approximately 90 degrees with respect to the fifth wall 28 of the housing 12. A spacer 118 separates the two light holders 16'''. The fluorescent light holders 16''' are shown in the enhanced lighting position in FIG. 7.

A fifth embodiment of the present inventions shown in FIG. 8, has a light holder 16' oriented diagonally with respect to the housing 12. The light holder 16' is pivotally connected to the housing 12 by pin mounting brackets 86' and pin's 84'. Spacers 118' are also provided. The fluorescent light holder 16' is shown in the enhanced lighting position in FIG. 8. In general, this embodiment is useful for providing enhanced lighting at selected angles with respect to a person, place, or thing. Also, light holder 16' can be pivoted to be flush with spacers 118', to provide downlighting or to simply store the light holder 16' in an aesthetic manner.

Figure 9A:
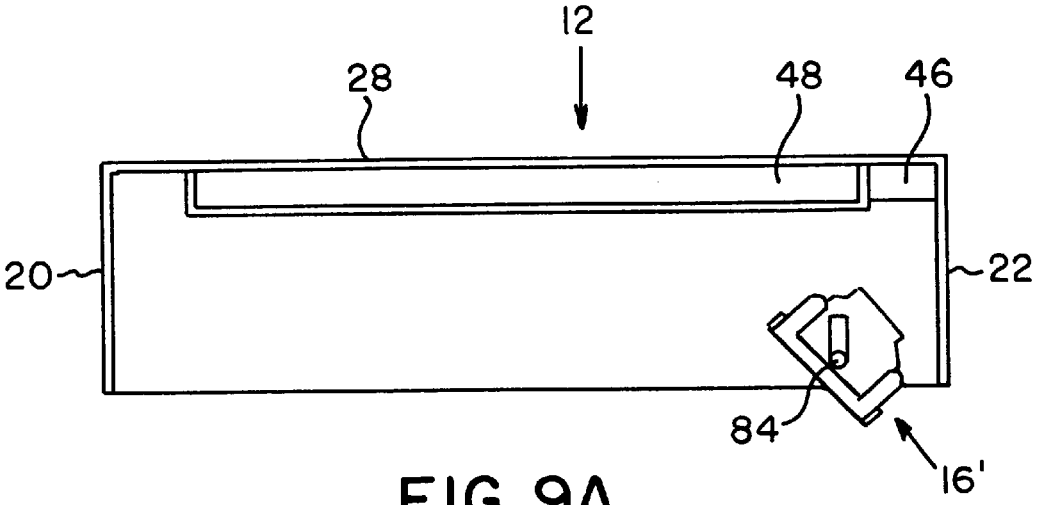
FIG. 9*a* is an adjustable fluorescent lighting fixture according to a sixth embodiment of the present invention.
Figure 9B:
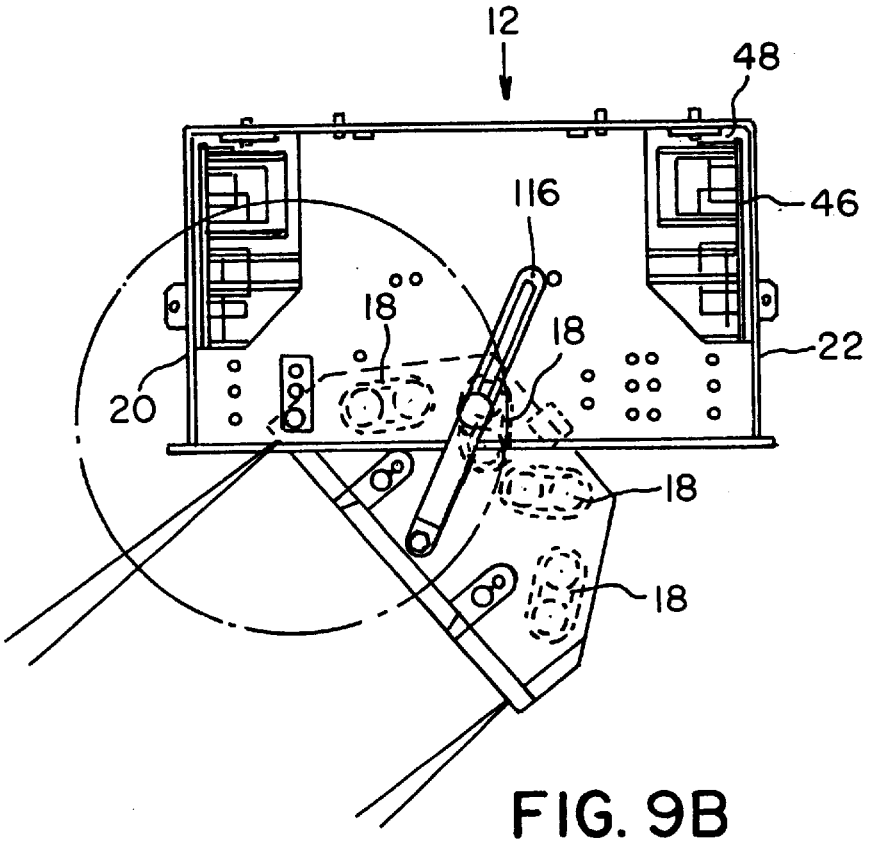
FIG. 9*b* is an adjustable fluorescent lighting fixture for small ceiling openings.

FIGS. 9*a* and 9*b* show a sixth embodiment of the present invention. In either embodiment, a single light holder 16' is positioned adjacent one side of a housing 12 having a ballast 46 and a wire harness 48. FIGS. 9*a* and 9*b* show the fluorescent light holder 16' pivoted in the enhanced lighting position. These embodiments are particularly useful in cases where there is only a partial need for enhanced lighting, such as accent lighting around the periphery of a room, or when small spaces are available in the ceiling.

FIG. 10 shows a seventh embodiment of the present invention. In this embodiment, which was discussed earlier in connection with the third embodiment shown in FIG. 5, the housing 12 has one or more mounting arms 14', including glide brackets 78', pivotally connected to the housing 12. Each mounting arm 14' holds one or more light holders 16". The fluorescent light holders 16" shown in FIG. 10 are in the enhanced lighting position. Although FIG. 10 shows two mounting arms 14' each having two light holders 16", a single mounting arm 14" having one or more light holders 16" is clearly contemplated and particularly useful in situations where intense luminosity is needed or where the person, place, or thing to be illuminated is further away from the light holders 16". Moreover, instead of equipping a single mounting arm with multiple light holders 16", each light holder 16" can be configured with one or more light sources 18, as shown generally in FIG. 8.

Figure 11:
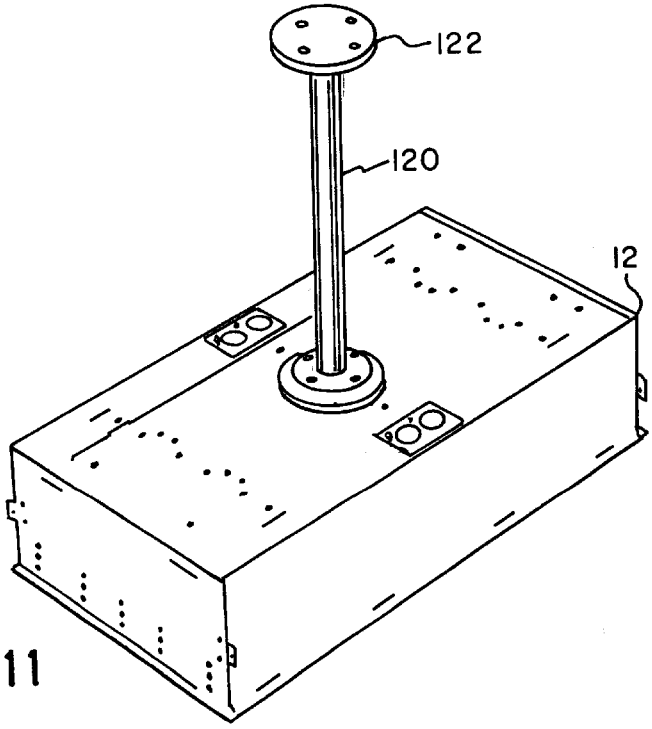
FIG. 11 is a top perspective view of an adjustable fluorescent lighting fixture according to any of FIGS. 1–10 with a housing hanger attached to the housing.

FIG. 11 shows a housing hanger 120, having a ceiling plate 122, connected to a housing 12. This particular configuration is useful in applications here cutting mounting holes in a ceiling is not desired.

During fluorescent downlighting (or fluorescent broadcast lighting), as shown generally in FIGS. 2, 3, and 5, the housing 12 is preferably permanently recessed into a ceiling, such as a suspended-type ceiling, and is preferably direct wired to a power source. As previously discussed, the housing 12 is designed to fit within normal building openings and clearances for commercial downlighting, thus permitting easy retrofitting of existing installations. The housing 12 can be provided with or without preformed holes, depending on local building ventilation codes, with the non-hole version being plenum approved. When in the storage position, the fluorescent light holder 16, 16', 16", 16'" and the mounting arm 14, 14', 14", are substantially contained within the housing 12, so as to provide a flush appearance with the ceiling or wall. The user then has the option to either energize the stored lights, to provide downlighting, or to leave them off.

When enhanced fluorescent lighting or enhanced fluorescent broadcast lighting is required, such as for live performances, teleconferencing distance leg (shown in FIG. 12), video telebroadcasting, photography, filming, video taping, or other situations, the light holder 16, 16', 16", 16'" attached to the mounting arm 14, 14', 14" is moved from storage position (either manually or through motorized means), in a direction away from the interior surface 30 of the housing 12, and into the enhanced lighting position. The light holder or holders 16 positioned on the second end 82 of the mounting arm 14 can be rotated 360 degrees about a longitudinal axis L running through the mounting arm 14, and otherwise have a near universal range of motion about pivot joint 80. Pivoting light source fixtures 16' can also be pivoted from the storage position to the enhanced lighting position, up to 180 degrees, shown in detail in FIGS. 4, 8, 9, and 12, In the embodiments shown in FIGS. 5, 10, and 12, the mounting arm 14' is pivoted from a storage position in a direction away from the housing 12 into an enhanced lighting position and, if so equipped via glide brackets 78', further telescoped in a direction away from the housing 12.

Figure 12:
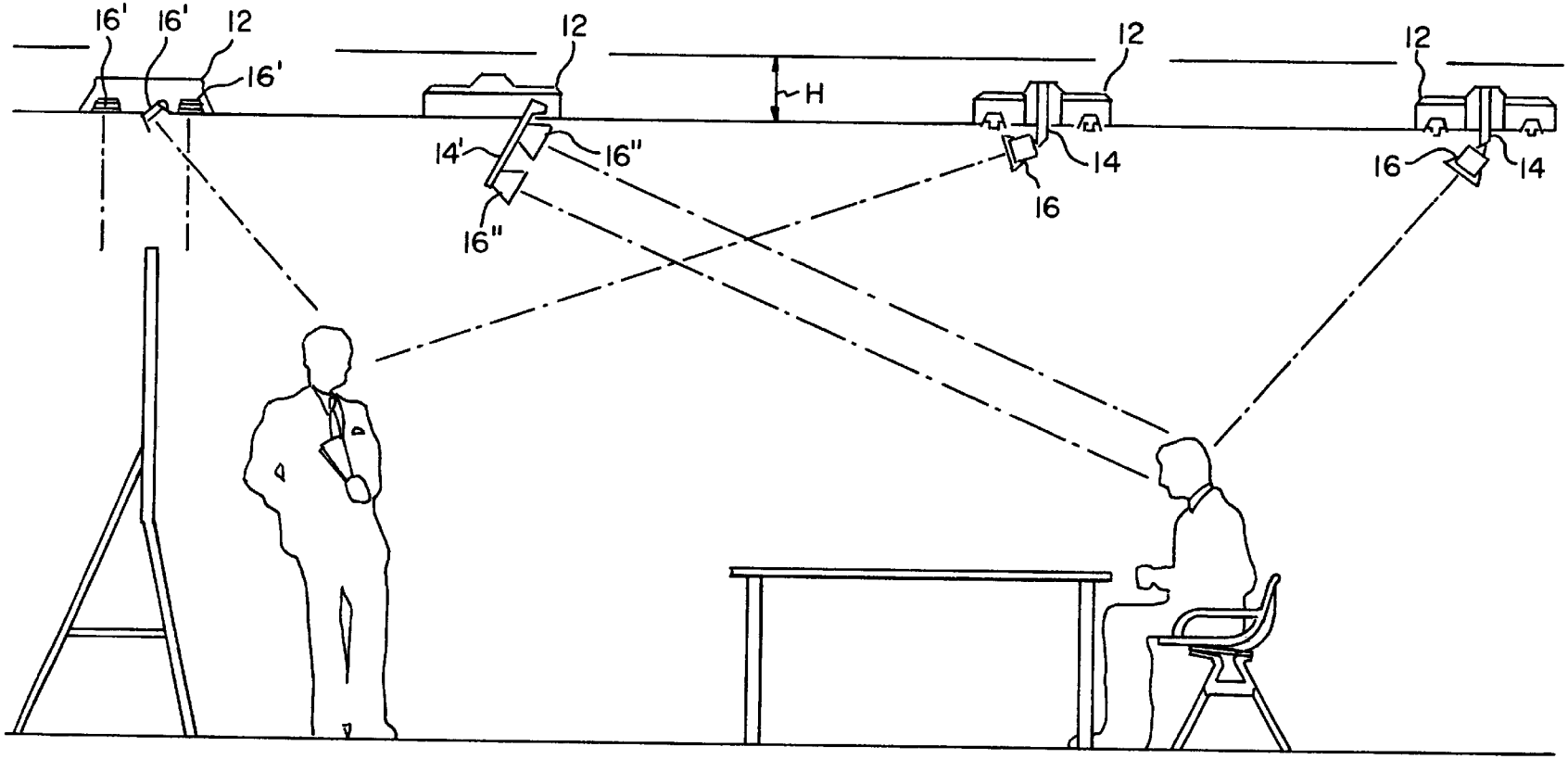
FIG. 12 is a side view of one possible adjustable fluorescent lighting fixture system adapted for teleconferencing or distance learning.

As shown in FIGS. 2, 3, and 5, when the need for enhanced lighting has ceased, the extended light holder or holders 16 are telescoped or otherwise retracted toward the housing 12 into a storage position. If desired, the remaining light holders 16', 16" pivotally attached to the housing 12 can be realigned into their storage position to provide downlighting. As shown in FIGS. 5, 10, and 12, the mounting arm 14' is retracted, if so equipped via glide bracket 78', and pivoted into a first position with respect to the housing for storage or to provide downlighting.

Any of the aforementioned (and later described) movements of light holders 16, 16', 16", 16'" or extension arms 14, 14', 14" may be executed manually or electromechanically, such as by programmable or manually-controlled solenoids motors 50 shown in FIG. 1. The motors 50 and ballasts 46 can be linked into one integrated system having at least one adjustable fluorescent lighting fixture 10 and a controller (discussed below) for manipulating the output of the ballast 46 or movement of the motor 50. The controller can be operated either manually, with a programmable infrared remote control, a computer-based program, or other suitable method or device.

Figure 13:
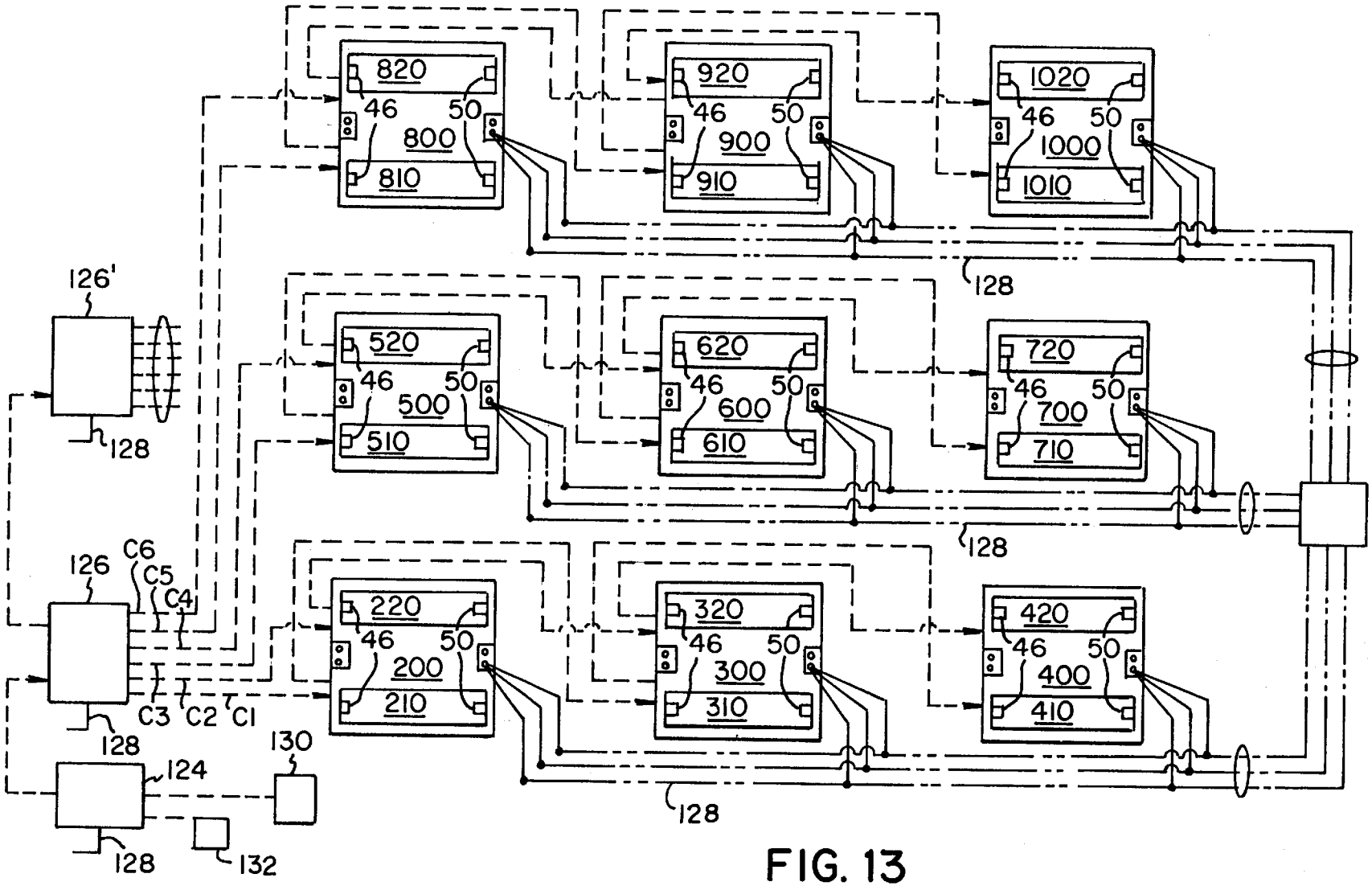
FIG. 13 is a schematic view of one possible dimmable, digitally-controlled lighting system according to the present invention.

FIG. 13 shows a schematic rendering of one possible lighting control system which includes a DMX-512 digital controller 124 controlled by a computer 130 or a remote control 132. At least one six-channel DMX-512 box 126 is positioned between the controller 124 and a DMX-512 compatible ballast is positioned adjacent an adjustable fluorescent lighting fixture 10. DMX-512 is a widely used international lighting standard maintained by the United States Institute of Theater Technology, Inc (USITT). The specification standard for DMX-512 is available commercially from USITT and is hereby incorporated by reference in its entirety. In general, however, DMX-512 is a digital controlling system that generates digital signals which are then transmitted to ballasts, motors, or other receivers. Each ballast, motor, or other receiver is identified by an individualized or group identification code. When a piece of digital information corresponding to the individual or group identification code of a respective ballast, motor, or other receiver is received, the receiver executes the digital command. Each command requires one channel of the DMX-512 protocol, which has 512 available channels. For example, as shown in FIG. 13, dimming six sets of lights requires six channels. Each motor also requires six channels, with one channel to lower the light holder, a second channel to pan the light holder left, a third channel to pan the light holder right, a fourth channel to tilt the light holder toward the housing, a fifth channel to tilt the light holder away from the housing, and a sixth channel to raise the light holder in a direction toward the housing. For simplicity, each channel for dimming is annotated in FIG. 13 and a second set of six channels 126', corresponding to one motor, is shown schematically.

With continuing reference to FIG. 13, a first DMX-512 box 126 is connected to a power supply 128, a DMX-512 controller 124, adjustable lighting fixtures 200–1000, and a second DMX-512 box 126'. Channels one through six C1–C6 of the first DMX-512 box 126 are each connected to one or more than one of the adjustable fluorescent lighting fixtures 200–1000. Adjustable fluorescent lighting fixture 200 has light holders 210 and 220; adjustable lighting fixture 300 has light holders 310 and 320; adjustable lighting fixture 400 has light holders 410 and 420; adjustable lighting fixture 500 has light holders 510 and 520; adjustable lighting fixture 600 has light holders 510 and 520; adjustable lighting fixture 600 has light holders 610 and 620; adjustable lighting fixture 700 has light holders 710 and 720; adjustable lighting fixture 800 has light holders 810 and 820; adjustable lighting fixture 900 has light holders 910 and 920; and adjustable lighting fixture 1000 has light holders 1010 and 1020.

Channel one C1 of the first DMX-512 box 126, which is controlled by a corresponding knob, slide, lever, or other suitable device on the DMX-512 controller 124, controls the ballasts 46 positioned adjacent to light holders 210, 310, and 410. Channel two C2 of the first DMX-512 box 126 controls the ballasts positioned adjacent to light holders 220, 320, and 420. Channel three C3 of the first DMX-512 box 126 controls the ballasts 46 positioned adjacent to light holders 510, 610, and 710. Channel four C4 of the first DMX-512 box 126 controls the ballasts positioned adjacent to light holders 520, 620, and 720. Channel five C5 of the first DMX-512 box 126 controls the ballasts 46 positioned adjacent to light holders 810, 910, and 1010. Channel six C6 of the first DMX-512 box 126 controls the ballasts 46 positioned adjacent to light holders 720, 820, and 920.

Each of the light holders connected to channel one C1, or any of the other channels C2–C6, can be adjusted as a group or individually. Moreover, any one of the other well-known digital or analog systems for controlling lighting can also be used to adjust the ballasts or motors. The motors may be stepper motors, solenoids, or other suitable devices.

It will be apparent to those in the art that any of the embodiments discussed herein can be used either individually or in combination. For example, a single adjustable lighting fixture 10 can include a light holder 16 that pivots with respect to the housing 12, a light holder 16 pivotally attached to a telescoping mounting arm 14, a light holder 16 positioned adjacent a mounting arm 14 pivotally connected to the housing 12, or any possible combination. It will also be apparent to those in the art that three, four, or even more light holders 16 may be provided on the mounting arms 14, 14', 14" depending on the application, that the light source fixtures can be oriented in any manner inside the housing 12, and as shown in FIGS. 7 and 8, one or more light sources 18 can be used in one holder 16. The additional light sources 18 are more appropriate for "long throw" applications, such as large distance—learning classrooms or auditoriums.

As discussed above, the present invention provides fluorescent illumination of interior spaces, enhanced fluorescent lighting, fluorescent broadcast lighting, or enhanced fluorescent broadcast lighting for video teleconferencing, highlight, and accent lighting for interior spaces. Thus, the present invention provides an adjustable fluorescent lighting source that can deliver fluorescent downlighting, enhanced fluorescent lighting, fluorescent broadcast lighting, and enhanced fluorescent broadcast lighting all from one housing fixture.

The invention has been described with reference to the preferred and other embodiments. Obvious modifications and alterations will occur to others upon reading and understanding the preceding detailed description. It is intended that the invention be construed as including all such modifications and alterations insofar as they come within the scope of the appended claims or the equivalents thereof.

We claim:

1. An adjustable fluorescent lighting fixture comprising:

a housing, said housing forming an interior cavity;

a light holder positioned in said interior cavity of said housing, said light holder configured to move from a storage position to an enhanced lighting position with respect to said housing;

a fluorescent light source connected to said light holder; and a ballast connected to said fluorescent light source, said ballast selected from the group consisting of a digitally adjustable ballast to dim and brighten the light source and a ballast adjustable by analog control to dim and brighten the light source.

2. The adjustable fluorescent lighting fixture as claimed in claim 1, wherein said light holder is configured to provide fluorescent downlighting in said storage position.

3. The adjustable fluorescent lighting fixture as claimed in claim 1, wherein said housing is recessed in a ceiling.

4. The adjustable fluorescent lighting fixture as claimed in claim 1, wherein said housing is mounted to a ceiling by a housing hanger connected to the ceiling and to said housing.

5. The adjustable fluorescent lighting fixture as claimed in claim 1, wherein said light holder is electro-mechanically moveable from the storage position to the enhanced lighting position, and back.

6. The adjustable fluorescent lighting fixture as claimed in claim 1, wherein said housing is hard wired to a power source.

7. The adjustable fluorescent lighting fixture as claimed in claim 1, wherein said light holder further comprises a reflector positioned between said light holder and said housing.

8. The adjustable fluorescent lighting fixture as claimed in claim 1, wherein said light holder further comprises a light source clip configured to receive said fluorescent light source.

9. The adjustable fluorescent lighting fixture as claimed in claim 1, wherein said light holder is pivotally movable 1 to 180 degrees with respect to said housing.

10. The adjustable fluorescent lighting fixture as claimed in claim 1 further comprising a mounting arm connected to said housing and said light holder, said mounting arm configured to allow said light holder to move from a storage position to an enhanced lighting position.

11. The adjustable fluorescent lighting fixture as claimed in claim 10, wherein said mounting arm is a glide bracket.

12. The adjustable fluorescent lighting fixture as claimed in claim 11, further comprising a pivot joint positioned between said mounting arm and said light holder.

13. The adjustable fluorescent lighting fixture as claimed in claim 12, wherein said mounting arm has a longitudinal axis and said light holder is rotatable 360 degrees about the longitudinal axis.

14. The adjustable fluorescent lighting fixture as claimed in claim 10, wherein said light holder further pivots at least 15 degrees with respect to said mounting arm.

15. The adjustable fluorescent lighting fixture as claimed in claim 10, wherein said mounting arm comprises a connection plate and slide members slidably engaging said connection plate.

16. The adjustable fluorescent lighting fixture as claimed in claim 10, wherein said mounting arm is pivotally connected to said housing.

17. The adjustable fluorescent lighting fixture as claimed in claim 16, wherein said light holder is moveable in a first direction away from said housing into said enhanced lighting position, and said light holder further telescopes in a direction away from said housing after said mounting arm is moved into said enhanced lighting position.

18. The adjustable fluorescent lighting fixture as claimed in claim 1, wherein said housing is a hollow box having a first wall, a second wall, a third wall opposite said first wall, and a fourth wall opposite said second wall, and said light holder has a longitudinal axis, wherein the longitudinal axis of said light holder passes through an intersection of said first and second walls and an intersection of said third and fourth walls of said housing and said light holder is rotatably moveable 1 to 180 degrees about said longitudinal axis.

19. The adjustable fluorescent lighting fixture as claimed in claim 18, wherein said enhanced lighting is enhanced fluorescent broadcast lighting.

20. The adjustable fluorescent lighting fixture as claimed in claim 19, wherein said fluorescent light source has a color rendering index of at least 75.

21. An adjustable fluorescent lighting fixture comprising:

a housing, said housing forming an interior cavity;

a light holder positioned in said interior cavity of said housing;

a mounting arm configured to move said light holder from a storage position to an enhanced lighting position with respect to said housing; and a fluorescent light source connected to said light holder, wherein said adjustable lighting fixture is configured to provide fluorescent downlighting when said light holder is in a storage position and enhanced fluorescent lighting when said light holder is moved via said mounting arm into said enhanced lighting position, and said light holder is electro-mechanically movable from said storage position to said enhanced lighting position.

22. The adjustable fluorescent lighting fixture as claimed in claim 21, wherein said housing is recessed in a ceiling.

23. The adjustable fluorescent lighting fixture as claimed in claim 21, wherein said housing is mounted to a ceiling by a housing hanger connected to said ceiling and to said housing.

24. The adjustable fluorescent lighting fixture as claimed in claim 21, further comprising a reflector positioned between said housing and said light holder.

25. The adjustable fluorescent lighting fixture as claimed in claim 21, wherein said housing is hard wired to a power source.

26. The adjustable fluorescent lighting fixture as claimed in claim 21, wherein said light holder further comprises a light source clip configured to receive said fluorescent light source.

27. The adjustable fluorescent lighting fixture as claimed in claim 21, wherein said fluorescent light source is connected to a ballast, said ballast selected from the group consisting of digitally adjustable and analog adjustable, to dim and brighten the light source.

28. The adjustable fluorescent lighting fixture as claimed in claim 21, wherein said light holder is pivotally moveable 1 to 180 degrees with respect to said housing.

29. The adjustable fluorescent lighting fixture as claimed in claim 21, wherein the mounting arm is a glide bracket.

30. The adjustable fluorescent lighting fixture as claimed in claim 21, further comprising a pivot joint positioned between said mounting arm and said light holder.

31. The adjustable fluorescent lighting fixture as claimed in claim 30, wherein said mounting arm has a longitudinal axis and said light holder is rotatable 360 degrees via said pivot joint about the longitudinal axis.

32. The adjustable fluorescent lighting fixture as claimed in claim 30, wherein said light holder pivots at least 15 degrees with respect to said mounting arm.

33. The adjustable fluorescent lighting fixture as claimed in claim 21, wherein said mounting arm comprises a connection plate and slide members slidably engaging said connection plate.

34. The adjustable fluorescent lighting fixture as claimed in claim 21, wherein said mounting arm is pivotally connected to said housing.

35. The adjustable fluorescent lighting fixture as claimed in claim 34, wherein said mounting arm is moveable further away from said housing after said mounting arm is pivoted into said enhanced lighting position.

36. The adjustable fluorescent lighting fixture as claimed in claim 21, wherein said enhanced fluorescent lighting is enhanced fluorescent broadcast lighting.

37. The adjustable fluorescent lighting fixture as claimed in claim 36, wherein said fluorescent light source has a color rendering index of at least 75.

38. A fluorescent lighting system comprising:

an adjustable fluorescent lighting fixture having a light holder and a fluorescent light source connected to said light holder in a housing;

means for moving said light holder from a storage position to an enhanced lighting position, said means for moving said light holder comprising a pin and a pin mounting bracket, said pin mounting bracket fixed with respect to said light holder housing and said light holder and said pin rotatable with respect to said pin mounting bracket;

a ballast connected to said light holder, said ballast selected from the group consisting of a digitally adjustable ballast to dim and brighten the light source and an adjustable analog ballast to dim and brighten the light source; and a controller connected to said ballast and said means for moving said light holder, wherein said ballast receives a signal from the controller, said signal selected from the group consisting of an analog signal and a digital signal.

39. The fluorescent lighting system as claimed in claim 38, wherein said analog signal is a 0–10 volt electronic signal.

40. The fluorescent lighting system as claimed in claim 38, wherein said controller is an analog potentiometer.

41. The fluorescent lighting system as claimed in claim 38, wherein said controller is a DMX-512 controller.

42. The fluorescent lighting system as claimed in claim 41, further comprising a DMX-512 box positioned between said controller and said ballast.

43. The fluorescent lighting system as claimed in claim 42, wherein said controller sends a digital DMX-512 signal through said DMX-512 box to said ballast.

44. The fluorescent lighting system as claimed in claim 38 further comprising a DMX-512 control chip integrated with said ballast.

45. The fluorescent lighting system as claimed in claim 38, wherein said fluorescent light source has a color rendering index of at least 75.

46. The fluorescent lighting system as claimed in claim 38, wherein said means comprises a motor for moving said light holder.

47. The fluorescent lighting system as claimed in claim 46, wherein said motor is adjusted by said controller.

48. The fluorescent lighting system as claimed in claim 46, wherein said motor receives an analog electronic signal from said controller.

49. The fluorescent lighting system as claimed in claim 46, wherein said motor receives a digital signal from said controller.

50. The fluorescent lighting system as claimed in claim 46, further comprising a DMX-512 box positioned between said controller and said motor.

51. The fluorescent lighting system as claimed in claim 50, wherein said controller sends a digital DMX-512 signal through said DMX-512 box to said motor.

52. The fluorescent lighting system as claimed in claim 38, further comprising a device selected from the group consisting of a central processing unit, a manual control, and a remote control for controlling said controller.

53. An adjustable fluorescent lighting fixture comprising:

a housing, said housing comprising a hollow box having a first wall, a second wall, a third wall opposite said first wall, and a fourth wall opposite said second wall, thereby forming an interior cavity;

a light holder positioned in said interior cavity of said housing, said light holder configured to move from a storage position to an enhanced lighting position with respect to said housing, said light holder having a longitudinal axis, wherein the longitudinal axis of said light holder passes through an intersection of the first and second walls and an intersection of the third and fourth walls of the housing, and the light holder is rotatably movable 1 to 180 degrees about said longitudinal axis; and a fluorescent light source connected to said light holder.

54. An adjustable fluorescent lighting fixture comprising:

a housing, said housing forming an interior cavity;

a light holder positioned in said interior cavity of said housing;

a mounting arm configured to move said light holder from a storage position to an enhanced lighting position with respect to said housing, and a fluorescent light source connected to said light holder, wherein said adjustable lighting fixture is configured to provide fluorescent downlighting when said light holder is in a storage position and enhanced fluorescent lighting when said light holder is moved via said mounting arm into said enhanced lighting position, and further wherein the fluorescent light source is connected to a ballast, said ballast selected from the group consisting of a digitally adjustable ballast and a ballast adjustable by analog control, to brighten and dim the fluorescent light source.

55. A fluorescent lighting system comprising:

an adjustable fluorescent lighting fixture having a light holder and a fluorescent light source connected to said light holder in a housing:

means for moving said light holder from a storage position to an enhanced lighting position;

a ballast connected to said light holder; and a controller connected to at least one of said ballast and said means for moving said light holder, wherein the controller is connected to the ballast, and further wherein the ballast receives a signal selected from the group consisting of an analog electronic signal from the controller and a digital signal front the controller.

56. The fluorescent lighting system as claimed in claim 55, wherein the controller is a DMX-512 controller.

57. The fluorescent lighting system as claimed in claim 55, wherein said means comprises a motor for moving said light holder.

58. The fluorescent lighting system as claimed in claim 55, further comprising a DMX-512 control chip integrated with said ballast.

* * * * *

UNITED STATES PATENT AND TRADEMARK OFFICE

CERTIFICATE OF CORRECTION

PATENT NO. : 6,517,216 B1 
DATED : February 11, 2003
INVENTOR(S) : Samuel P. Cercone et al.

It is certified that error appears in the above-identified patent and that said Letters Patent is hereby corrected as shown below:

Title page,
Item [56], References Cited, U.S. PATENT DOCUMENTS, last reference, "6,230,172" should read -- 6,203,172 --.
Insert: -- 2,740,885 A 4/1956 Kruger……362/220 --.

Column 8,
Line 26, "present inventions" should read -- present invention --.
Line 30, "and pin's" should read -- and pins --.
Line 66, "here cutting" should read -- where cutting --.

Column 9,
Line 19, "distance leg" should read -- distance learning --.

Column 16,
Line 6, "signal front" should read -- signal from --.

Signed and Sealed this

Twenty-sixth Day of August, 2003

JAMES E. ROGAN
*Director of the United States Patent and Trademark Office*